US007221086B2

(12) United States Patent
Nakamura et al.

(10) Patent No.: US 7,221,086 B2
(45) Date of Patent: May 22, 2007

(54) DISPLAY DEVICE INCLUDING A SHIELD MEMBER

(75) Inventors: Tomoki Nakamura, Chiba (JP); Yuuichi Kijima, Chosei (JP); Yoshiyuki Kaneko, Hachioji (JP); Toshifumi Ozaki, Mobara (JP); Shigemi Hirasawa, Chiba (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 55 days.

(21) Appl. No.: 10/664,966

(22) Filed: Sep. 22, 2003

(65) Prior Publication Data

US 2004/0056582 A1 Mar. 25, 2004

(30) Foreign Application Priority Data

Sep. 20, 2002 (JP) ..... 2002-274447

(51) Int. Cl.
*H01J 19/42* (2006.01)
*H01J 19/24* (2006.01)

(52) U.S. Cl. ..... 313/497; 313/496; 313/613; 313/238

(58) Field of Classification Search ..... 313/495, 313/496–497, 238, 613–614
See application file for complete search history.

(56) References Cited

U.S. PATENT DOCUMENTS 5,588,893 A 12/1996 Kaftanov
5,600,203 A * 2/1997 Namikawa et al. ..... 313/495
5,656,889 A 8/1997 Niyama
5,717,286 A 2/1998 Itoh
6,208,072 B1 3/2001 Watanabe
6,426,588 B1 * 7/2002 Yanagisawa ..... 313/422
6,786,787 B2 * 9/2004 Yanagisawa ..... 445/24
6,867,537 B2 * 3/2005 Sato et al. ..... 313/495
2001/0050529 A1 * 12/2001 Lee ..... 313/495
2002/0021081 A1 * 2/2002 Tajima et al. ..... 313/495

FOREIGN PATENT DOCUMENTS

JP 7-326306 12/1995
JP 10-52938 2/1998
JP 11-144652 5/1999
JP 2000-323078 11/2000
JP 2001-101965 4/2001
JP 2001-256907 9/2001
JP 2001-338528 12/2001

* cited by examiner

*Primary Examiner*—Karabi Guharay
(74) *Attorney, Agent, or Firm*—Antonelli, Terry, Stout & Kraus, LLP.

(57) ABSTRACT

To provide a display device having the long lifetime and the high reliability by preventing the generation of a spark or a dark current between terminals of cathode lines and an anode, a shielding member is arranged between the terminals of the cathode lines and the anode so as to ensure shielding between the terminals and the anode.

5 Claims, 15 Drawing Sheets

DISPLAY DEVICE INCLUDING A SHIELD MEMBER

BACKGROUND OF THE INVENTION

The present invention relates to a display device which utilizes an emission of electrons into a space that is in a vacuum state, which space is defined between a face substrate and a back substrate; and, more particularly, the invention relates to a display device which has cathode lines having electron emitting sources and control electrodes which control quantity of electrons emitted from the electron emitting sources, and which, at the same time, can exhibit stable display characteristics by maintaining a vacuum in the space between the face substrate and the back substrate.

As a display device which exhibits high brightness and high definition, color cathode ray tubes have been widely used conventionally. However, along with the recent desire for information processing equipment or television broadcasting that is capable of providing images of higher quality, the demand for planar displays (panel displays) which are light in weight and require a small space, while also exhibiting high brightness and high definition, has been increasing.

As typical examples of such panel display devices, liquid crystal display devices, plasma display devices and the like have been developed. More, particularly, as display devices which can provide higher brightness, it is expected that various other kinds of panel-type display devices, including a display device which utilizes an emission of electrons from electron emitting sources into a vacuum (hereinafter referred to as "an electron emission type display device" or "a field emission type display device") and an organic EL display device, which is characterized by low power consumption, will be put into practice.

Among panel type display devices, such as the above-mentioned field emission type display device, a display device having an electron emission structure which was developed by C. A. Spindt et al, a display device having an electron emission structure of a metal-insulator-metal (MIM) type, a display device having an electron emission structure which utilizes an electron emission phenomenon based on a quantum theory tunneling effect (also referred to as "surface conduction type electron emitting source), and a display device which utilizes an electron emission phenomenon having a diamond film, a graphite film and carbon nanotubes and the like have been known.

One type of field emission type display device includes a back substrate, on which cathode lines having electron-emission-type electron emitting sources and a control electrode are formed on an inner surface thereof, and a face substrate, on which an anode and a fluorescent material are formed on an inner surface that faces the back substrate, wherein both substrates are laminated to each other by inserting a sealing frame between the inner peripheries of both substrates, after which the inside thereof is evacuated. Further, to set the gap between the back substrate and the face substrate to a given value, gap holding members are provided between both substrates.

FIG. 16 is a schematic plan view of a back substrate, which illustrates the constitution of a field emission type display device as viewed from the side of a face substrate (not shown in the drawing). The back substrate 1 is configured such that, on a substrate which is preferably made of glass, alumina or like insulating material, a plurality of cathode lines 2 having electron emitting sources and a plurality of control electrodes of a plate member 4, constituted of a plurality of strip-like electrode elements, are formed. The cathode lines 2 extend in a first direction on the back substrate 1 and are arranged in plural numbers in parallel in a second direction which crosses the first direction. The cathode lines 2 are patterned by printing a conductive paste containing silver or the like, and electron emitting sources are arranged on the surface (face substrate side) of the cathode lines 2. End portions of the cathode lines 2 are extended out to the outside of a frame body 90, which constitutes a sealing frame, as cathode-line lead lines 20, while the opposite end portions thereof extend to terminals 22, which are arranged inside the frame body 90 and outside the display region AR.

On the other hand, the control electrodes 4 are manufactured as separate members and formed on the back substrate 1 at positions to be described later. That is, the control electrodes 4 are arranged close to and above the cathode lines 2 having the electron emitting sources disposed thereon (face substrate side), and, at the same time, they face the cathode lines 2 and are disposed with a given distance therebetween over the whole area of the display region AR. A large number of strip-like electrode elements 41, which constitute the control electrodes 4, extend in the above-mentioned second direction and are juxtaposed in the above-mentioned first direction. The strip-like electrodes 41 have open holes which constitute electron passing apertures at crossing portions thereof aligned with the above-mentioned electron emitting sources on the cathode lines 2. Electrons which are emitted from the electron emitting sources of the cathode lines 2 pass through the electron passing apertures toward the face substrate side (anode side), and pixels are formed over the crossing portions.

The control electrodes 4 are preferably formed such that a thin plate (having a thickness of about 0.05 mm, for example) mainly made of aluminum or iron is formed into a large number of strip-shaped thin plates by etching using a photolithography technique, wherein a large number of electron passing apertures are formed in each strip-shaped thin plate. The control electrodes 4 are fixed to the back substrate 1 by press members 60 or the like that are formed of an insulation body made of glass material at a fixing portion which is arranged outside a display region AR. In the vicinity of the fixing portion or in the vicinity of the frame body 90, lead lines (control-electrode lead lines) 40 are connected to the control electrodes 4 and one end of each of the lead lines 40 extends out to the outer periphery of the display device. Here, it may be possible to use the frame body 90 to perform the function of the press member 60. Then, in response to a potential difference between the cathode lines 2 and the control electrodes 4, an emission quantity (including ON and OFF states) of electrons from the electron emitting sources provided on the cathode lines 2 can be controlled.

On the other hand, the face substrate, which is not shown in the drawing, is formed of an insulation material having light transmissivity, such as glass or the like, and anodes and fluorescent materials are formed on an inner surface thereof. The fluorescent materials are disposed in areas corresponding to the pixels which are formed at the crossing portions between the cathode lines 2 and the control electrodes 4. In the drawing, x indicates the direction of extension of the control electrodes 4, y indicates the direction of extension of the cathode lines 2, and z indicates the direction which is perpendicular to the substrate surfaces of the back substrate and the face substrate.

The back substrate 1 and the face substrate having the above-mentioned constitution are sealed together by way of the frame body 90, and the inside space sealed by the sealing frame 90 is evacuated through an exhaust hole 11 so that a vacuum of $10^{-5}$ to $10^{-7}$ Torr is created therein, thus forming a field emission type display device. The above-mentioned electron emitting source is constituted of carbon nanotubes (CNT), diamond-like carbons (DLC), other field emission cathode material or other field emission shapes.

Here, as examples of literature which disclose this type of electron emission type display device, except for the constitution of the control electrodes formed of the strip-like electrode elements, reference is made to Japanese Unexamined Patent Publication 1995-326306, Japanese Unexamined Patent Publication 1999-144652, Japanese Unexamined Patent Publication 2000-323078, and Japanese Unexamined Patent Publication 2001-338528.

SUMMARY OF THE INVENTION

The above-described electron emission type display device is of a type in which electrons from an electron emitting source pass through an aperture formed in a control electrode and impinge on a fluorescent material of an anode and excite the fluorescent material to emit light and to produce a display. This display device has an excellent constitution in the form of a planar display, which is capable of producing images that have excellent characteristics, such as high brightness and high definition, and is light-weight and requires a small space.

However, in spite of such excellent characteristics, the conventional electron emission type display device has the following drawbacks. That is, in the above-described electron emission type display device having cathode lines as shown in FIG. 16, the distance between the cathode lines on the back substrate and the anode on the face substrate is set to several mm; and, with such a constitution, the display device is operated by applying a cathode voltage of 0V to the cathode lines, by applying an anode voltage of several KV to some ten KV to the anode, and by applying a grid voltage of about 100 V to the control electrode. However, the terminals of the cathode lines extend and are present outside the area of the control electrodes, as well as outside the display region AR; and, hence, the anode and the cathode lines directly face each other at the terminal portions thereof. Further, the terminals have edge portions; and, hence, there is a possibility that a spark or a dark current is easily generated between the terminals and the anode. When a spark or dark current is generated, the display becomes unstable, and, at the same time, the display is degraded, and, hence, the reliability of the display is reduced. Further, an undesired current, which does not contribute to the display, flows so that extension of the life of the device is impeded.

The conventional electron emission type display device has the above-mentioned drawbacks, and so there is a need to provide some means for solving such drawbacks. Accordingly, it is an object of the present invention to provide a reliable display device which is capable of producing a display of high definition and of having a long life by preventing the generation of a spark or a dark current between the terminals of the cathode lines and the anode.

To achieve the above-mentioned object, the present invention is characterized by an arrangement in which a shield member is inserted between the terminals of cathode lines and the anode so as to ensure shielding between the terminals and the anode. Hereinafter, typical constitutions of the display device according to the present invention will be described.

The display device according to the present invention includes a face substrate, which has an anode and a fluorescent material on an inner surface thereof, and a back substrate which has a plurality of cathode lines, which extend in a first direction, are juxtaposed in a second direction which crosses the first direction, and which have electron emitting sources disposed thereon, and a plurality of control electrodes, which are constituted by arranging a plurality of strip-like electrode elements to cross the above-mentioned cathode lines in a non-contact state within a display region in parallel, so as to extend in the second direction and be juxtaposed in the above-mentioned first direction. The control electrodes have electron passing apertures for allowing electrons from the electron emitting sources to pass therethrough toward the above-mentioned face substrate. The back substrate, which has the above-mentioned control electrodes and the above-mentioned cathode lines disposed on an inner surface thereof, faces the face substrate with a given distance therebetween, and a frame body, which is inserted between the above-mentioned face substrate, the back substrate and is arranged around the above-mentioned display region to establish and maintain the above-mentioned given distance between the substrates.

In accordance with the present invention, the cathode lines have one end thereof terminated outside the display region and inside the frame body, and a shield member is inserted between the terminals and the anode so as to ensure shielding between the terminals and the anode.

As the above-mentioned shield member, a member having the same shape as the strip-like electrode elements, which do not have the above-mentioned electron passing apertures, or a strip-like electrode element which has the above-mentioned electron passing apertures, can be used. Further, the shield member may be constituted of an insulation layer which covers the above-mentioned terminals, and the shield member also may be constituted of a separate inner frame body which has substantially the same height as the outer frame body.

According to the above-mentioned examples, by inserting the shield member between the terminals of the cathode lines and the anode to ensure shielding between the terminals of the cathode lines and the anode, it is possible to prevent the generation of a spark and an undesired current, whereby it is possible to provide a display device which exhibits high reliability and has a long life.

Further, a display device according to the present invention includes a face substrate which has an anode and a fluorescent material on an inner surface thereof, and a back substrate which has a plurality of cathode lines, which extend in a first direction, are juxtaposed in a second direction which crosses the first direction, and which have electron emitting sources disposed thereon, and a plurality of control electrodes, which are constituted by arranging a plurality of strip-like electrode elements in parallel to cross the above-mentioned cathode lines in a non-contact state within a display region, so as to extend in the second direction and be juxtaposed in the first direction. The control electrodes have electron passing apertures for allowing electrons from the electron emitting sources to pass therethrough toward the above-mentioned face substrate. The back substrate, which has the above-mentioned control electrodes and the above-mentioned cathode lines on an inner surface thereof, faces the face substrate with a given distance therebetween, and a frame body, which is inserted between the above-mentioned face substrate and the back substrate, is arranged around the above-mentioned display region to establish and maintain the above-mentioned given distance between the substrate.

The above-mentioned cathode lines have one end thereof terminated at positions outside the above-mentioned display region and where the frame body is superposed on the cathode lines; and, hence, it is possible to ensure shielding between the terminals and the above-mentioned anode using the frame body, whereby it is unnecessary to add another member for shielding, so that the cost also can be reduced.

It is needless to say that the present invention is not limited to the above-mentioned examples or to the embodiments to be described later, and various modifications can be made without departing from the technical concept of the present invention.

DESCRIPTION OF THE PREFERRED EMBODIMENTS

Figure 1:
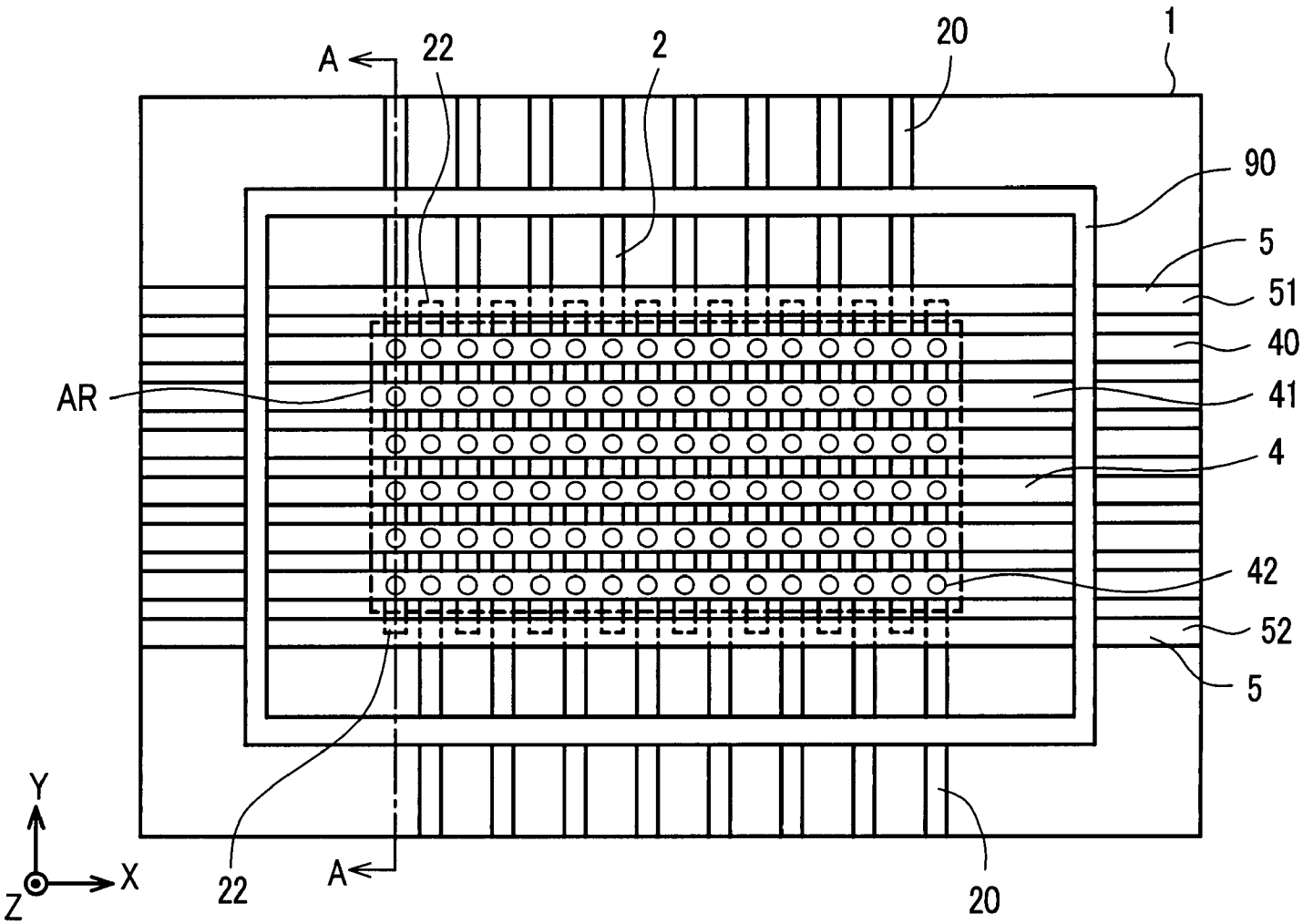
FIG. 1 is a plan view showing the constitution of a back panel representing a first embodiment of a display device according to the present invention.
Figure 2:
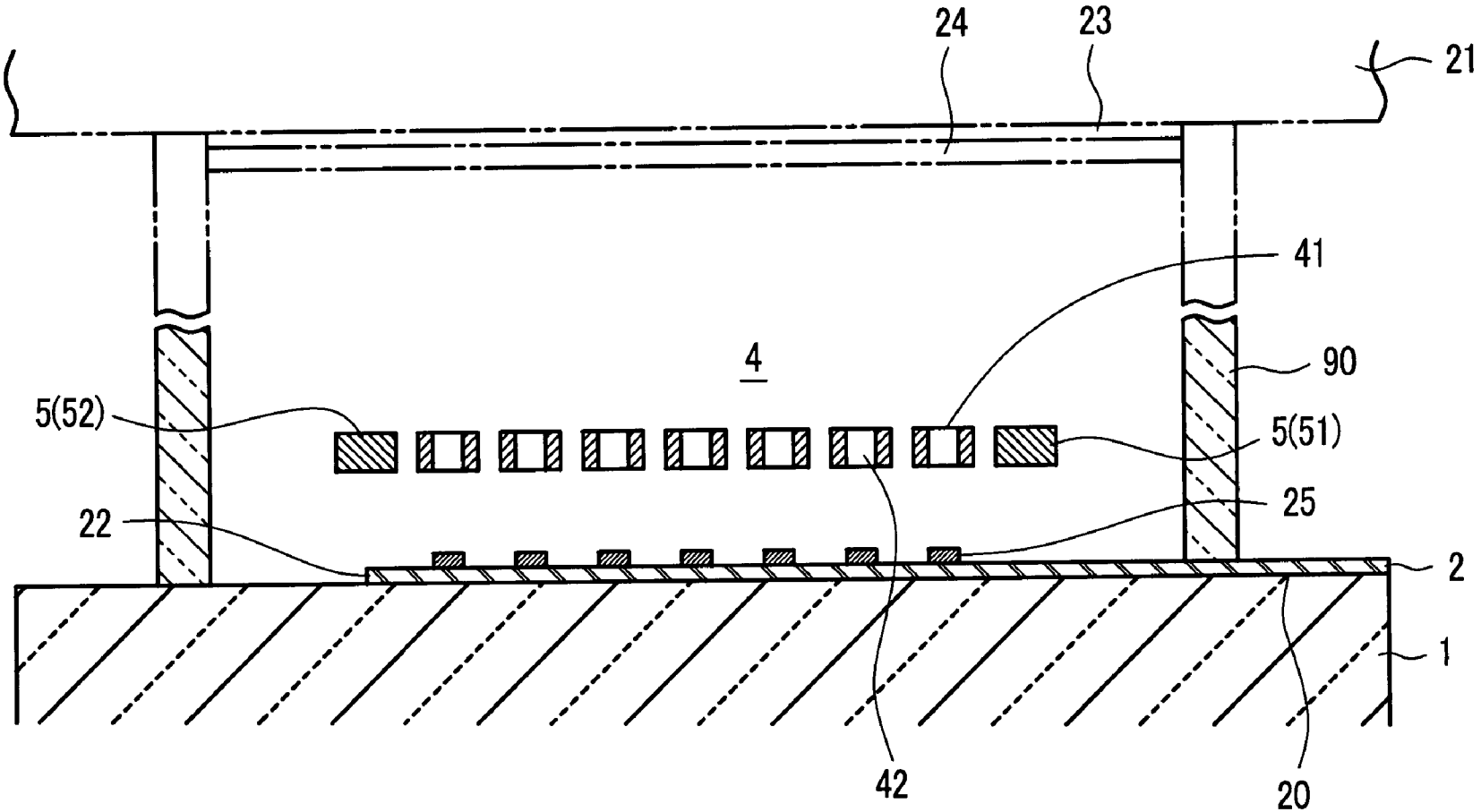
FIG. 2 is a cross-sectional view taken along a line A—A in FIG. 1.

Preferred embodiments of the present invention will be explained in detail hereinafter in conjunction with the drawings. FIG. 1 is a plan view schematically showing the constitution of a back substrate in a first embodiment of a display device according to the present invention, and FIG. 2 is a cross-sectional view taken along a line A—A in FIG. 1. Here, in FIG. 2, the relationship among a face substrate 21, an anode 23 and a fluorescent material 24 is indicated by a phantom line.

As seen in FIG. 1 and FIG. 2, a back substrate 1 is constituted of an substrate suitably formed of glass, alumina or the like. Cathode lines 2 extend in a first direction (y direction) on the back substrate 1 and are juxtaposed in a plural number in a second direction (x direction) which crosses the first direction. The cathode lines 2 are formed by patterning using a conductive paste containing silver or the like by printing or the like, and electron emitting sources 25 are formed on surfaces thereof (face substrate 21 side). Carbon nanotubes, for example, are used as the electron emitting sources 25, as described previously.

Further, one end of each of the cathode lines 2 extends out as a cathode-line lead line portion 20 to the outside of a frame body 90, which constitutes a sealing frame, while the opposite end portions of the cathode lines 2 extend to terminals 22 inside the frame body 90 and outside a display region AR. In this embodiment, the cathode lines 2 are positioned such that the cathode-line lead line portion 20 are arranged at every other line at upper and lower sides of the back substrate 1, as seen in the drawing. A plurality of control electrodes 4 are arranged above (face substrate 21 side) and close to the cathode lines 2 that have the electron emitting sources 25 disposed thereon, that is, close to the cathode lines 2 by approximately 0.01 mm or less. Further, the control electrodes 4 are arranged over at least the whole area of the display region AR so as to face the cathode lines 2.

The control electrodes 4 and the cathode lines 2 are electrically insulated from each other. Reference symbol 40 indicates control-electrode lead lines, and these control-electrode lead lines 40 are configured to extend to both the left and right sides of the back substrate 1, as seen in the drawing. A plurality of strip-like electrode elements 41 constitute the control electrodes 4. The strip-like electrode elements 41 are formed of an iron-based stainless steel material or an iron material, and they have a plate thickness of approximately 0.025 mm to 0.150 mm. These strip-like electrode elements 41 extend in the x direction and are juxtaposed in the y direction. It is preferable that the strip-like electrode elements 41 are integrally formed with the control-electrode lead lines 40. Electron passing apertures, which are constituted of holes, are formed in the strip-like electrode elements 41. One or a plurality of electron passing apertures 42 are arranged at positions where the strip-like electrode element 41 crosses each of the cathode lines 2, which positions are coaxial with the electron emitting sources 25 so as to allow each electrons emitted from the electron emitting source 25 to pass therethrough toward the anode 23. The distance between the anode 23 and the above-mentioned control electrodes 4 is set to several mm, that is, 3 mm, for example.

Strip-like shield members 5 are arranged close to the outermost control electrodes 4 such that the shield members 5 cover the terminals 22 of the cathode lines 2 and isolate them from the anode 23. Using two shield members 5 (51, 52), the terminals 22 and the anode 23 are shielded from each other. In this example, although the distance between the shield members 5 and the anode 23 is set to be equal to the distance between the control electrodes 4 and the anode 23, the distance may be determined based on the shape, the potential or the like of the shield members 5.

The shield members 5 may have the same specification as the above-mentioned strip-like electrode elements 41, except that the shield members 5 do not have electron passing apertures 42. Alternatively, the shield members 5 may use the strip-like electrode element 41 per se. In this case, by adopting the arrangement in which the electron passing apertures 42 and the above-mentioned terminals are not superposed on each other, a further shielding effect can be expected. Further, by electrically connecting the shield members 5 and the control electrodes 4, it is possible to enhance the shielding effect.

Based on such a constitution, electrons emitted from the electron emitting sources 25 pass through the electron passing apertures 42 of the control electrode 4, to which a grid voltage of approximately 100V is applied while receiving control, and impinge on the fluorescent material 24 that is formed on the anode 23 of the face substrate 21, to which an anode voltage of several KV to several tens KV is applied, whereby light is emitted from the fluorescent material 24 so as to produce a given display. During such an operation, according to this embodiment, the terminals 22 of the cathode lines 2 and the anode 23 are shielded from each other around the periphery of the display region by the shielding materials 5; and, hence, it is possible to prevent the anode potential from affecting the terminals 22, so that the generation of a spark or a dark current between the terminals 22 and the anode 23 can be suppressed. This degradation of the display can be obviated, whereby a display device which can produce a high-definition display and exhibit high reliability over a long lifetime can be obtained.

Figure 3:
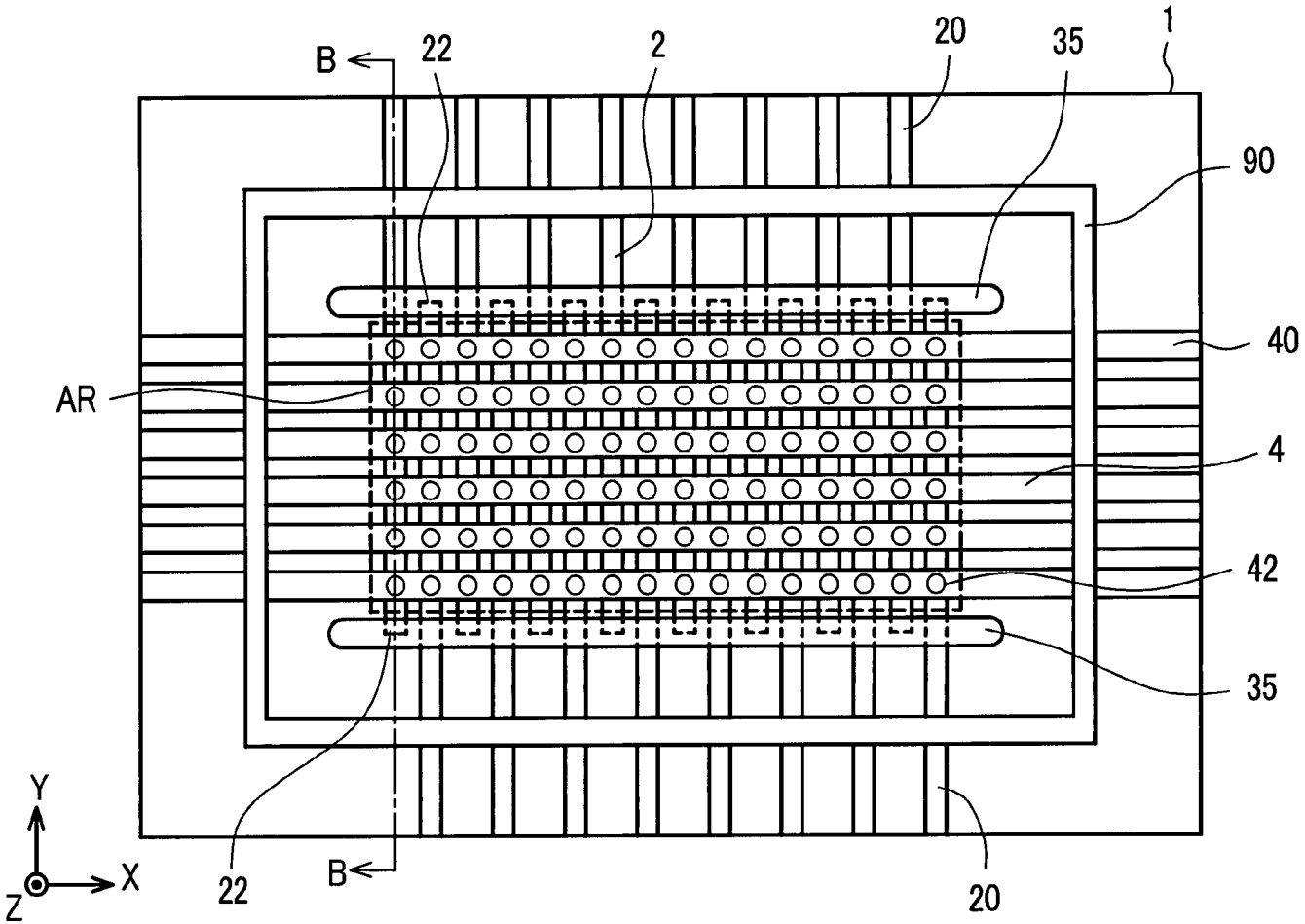
FIG. 3 is a plan view showing the constitution of a back panel representing a second embodiment of a display device according to the present invention.
Figure 4:
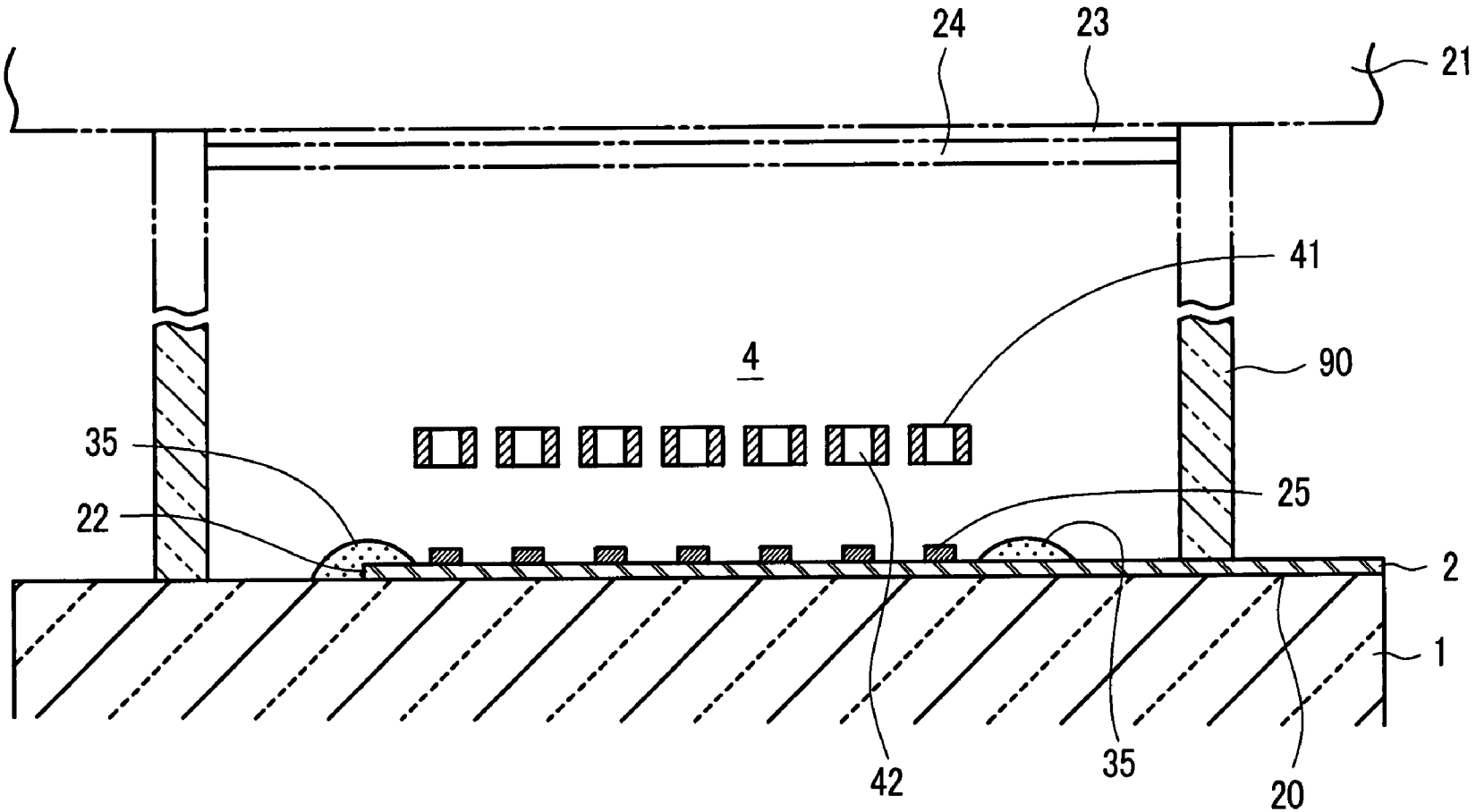
FIG. 4 is a cross-sectional view taken along a line B—B in FIG. 3.

FIG. 3 is a plan view schematically showing the constitution of a back substrate in a second embodiment of the display device according to the present invention. Further, FIG. 4 is a cross-sectional view taken along a line B—B in FIG. 3. Parts having functions identical to the parts shown in FIG. 1 and FIG. 2 are identified by the same symbols. Here, in FIG. 4, the relationship among a face substrate 21, an anode 23 and a fluorescent material 24 is indicated by a phantom line in the same manner as the display device shown in FIG. 2.

In FIG. 3 and FIG. 4, reference symbol 35 indicates shield members. The shield members 35 are formed of an insulating material, such as frit glass, and are applied and arranged to cover terminals 22. Since the shield members 35 are arranged in a vacuum atmosphere, it is preferable to form the shield members 35 of a material which emits a small amount of gas. When the shield members 35 are formed of a material such as frit glass, which requires high temperature treatment, by baking the material before forming the electron emitting sources 25, it is possible to obtain an advantageous effect in that any adverse influence on the electron emitting sources 25 can be reduced.

Due to the constitution provided by this embodiment, the terminals 22 can be completely shielded by the shield members 35, and, hence, a drawback attributed to turn-around of the electric field can be solved. Accordingly, in addition to the above-mentioned effect in which the generation of a spark and a dark current is superposed, the workability can be enhanced by integrally handling the shield members 35 and the back substrate 1; and, at the same time, it is possible to obtain a display device which can produce a display with high definition and can exhibit high reliability and a long lifetime.

Figure 5:
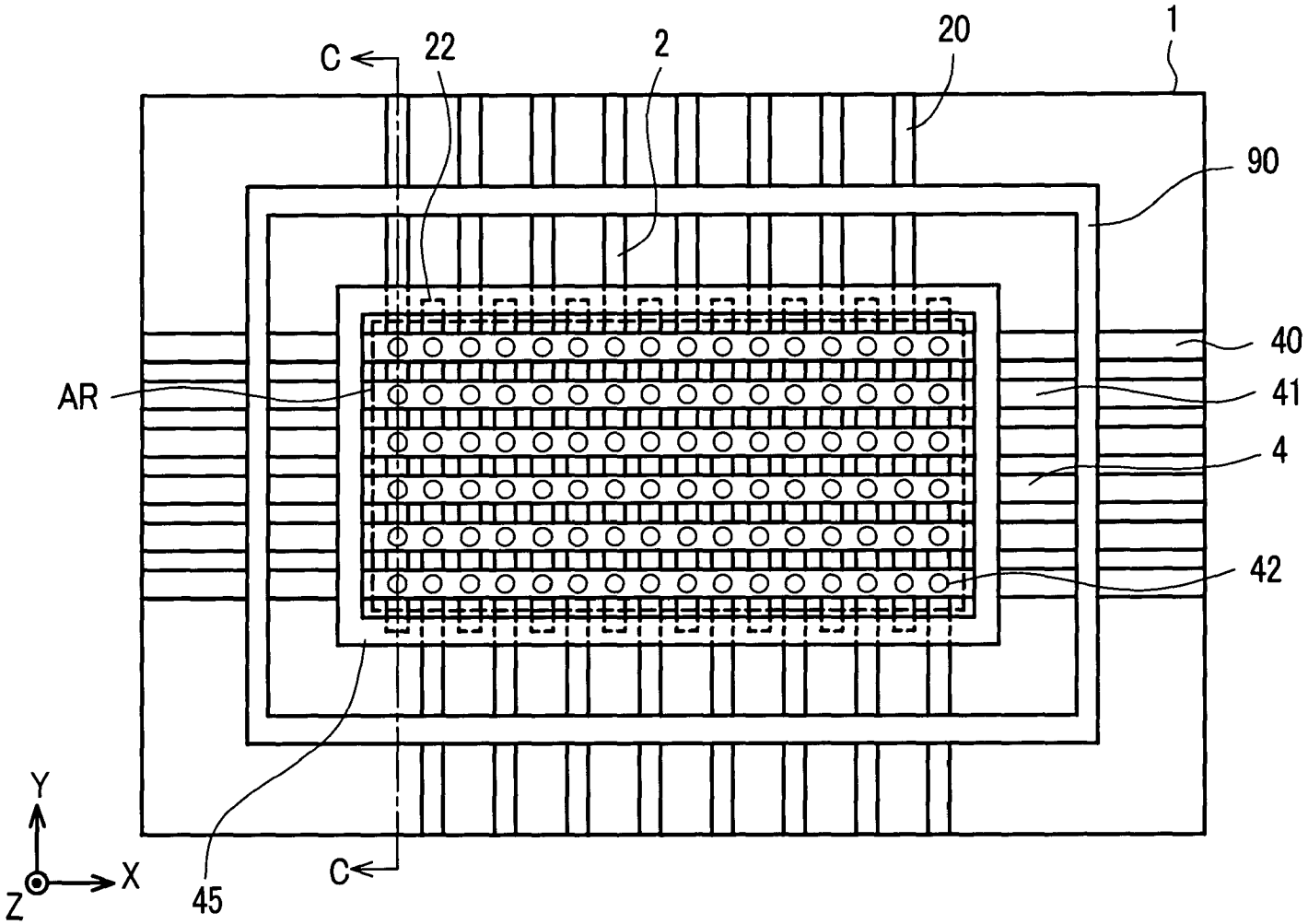
FIG. 5 is a plan view showing the constitution of a back panel representing a third embodiment of a display device according to the present invention.
Figure 6:
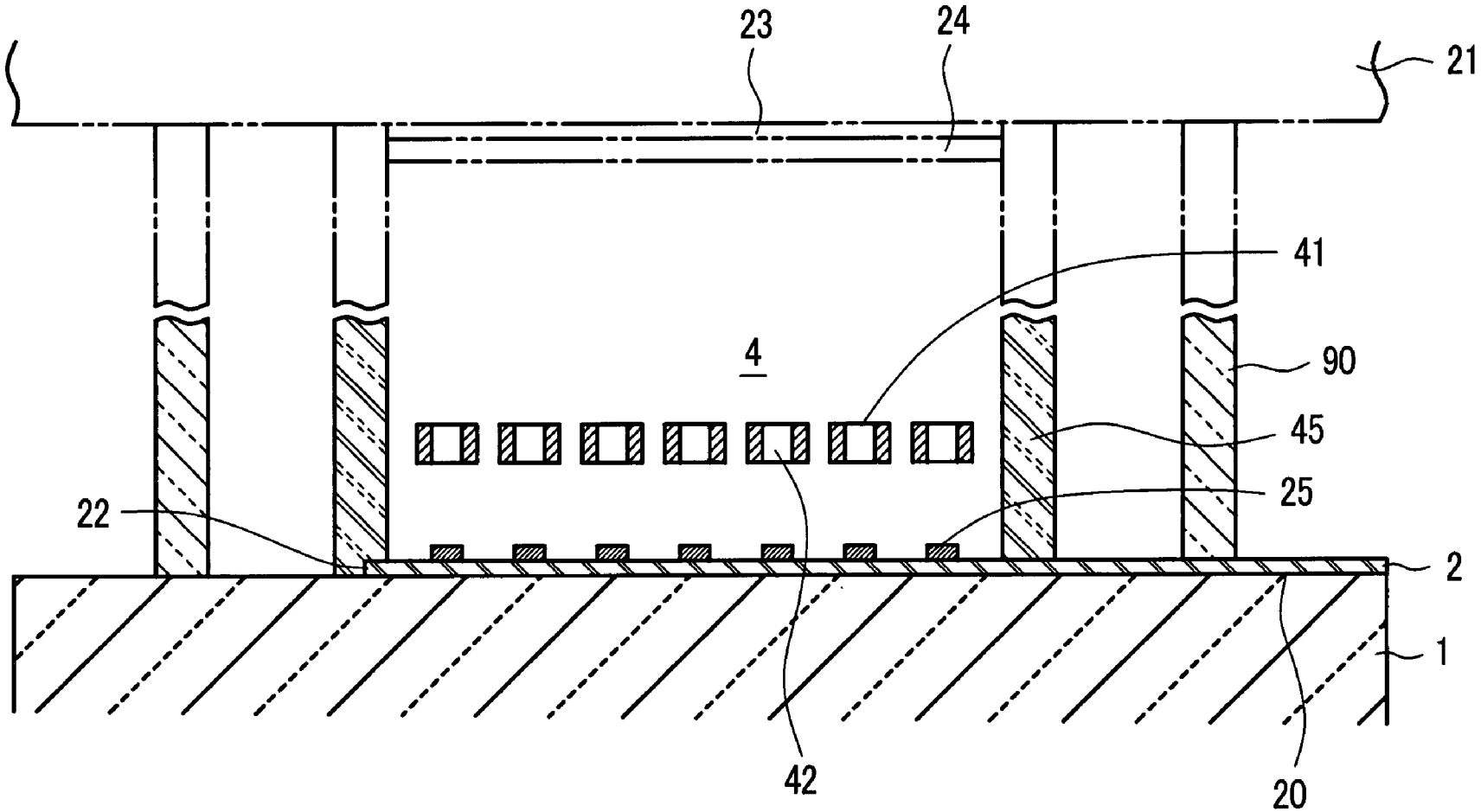
FIG. 6 is a cross-sectional view taken along a line C—C in FIG. 5.

FIG. 5 is a plan view schematically showing the constitution of an essential part of a back substrate side for explaining the third embodiment of the display device according to the present invention. Further, FIG. 6 is a cross-sectional view of an essential part taken along a line C—C in FIG. 5. In FIG. 5 and FIG. 6, parts having the functions identical to the parts shown in FIG. 1 to FIG. 4 are given same symbols. Here, in FIG. 6, the arrangement relationship among a face substrate 21, an anode 23 and a fluorescent material 24 is indicated by a phantom line in FIG. 6 in the same manner as the display device shown in FIG. 2 and FIG. 4.

In FIG. 5 and FIG. 6, reference symbol 45 indicates a shield member having a frame shape. The shield member 45 is formed of a glass plate or a ceramic plate, and it is arranged such that a lower end surface thereof covers terminals 22 inside a frame body 90, which constitutes a sealing frame. The height of the shield member 45 is set to be equal to or lower than the height of the frame body 90. The display region AR is located inside the shield member 45.

Due to the constitution provided by this embodiment, the terminals 22 can be completely shielded by the shield member 45, and, hence, the drawback attributed to turn-around of the electric field can be solved. Accordingly, in addition to the above-mentioned effect in which the generation of a spark and a dark current is superposed, the shield member 45 cooperates with the frame body 90 to set the distance between the back substrate 1 and the face substrate 21 to a fixed value, thus preventing degradation of the display, whereby it is possible to obtain a display device which can produce a display with high definition and can exhibit high reliability and a long lifetime.

Figure 7:
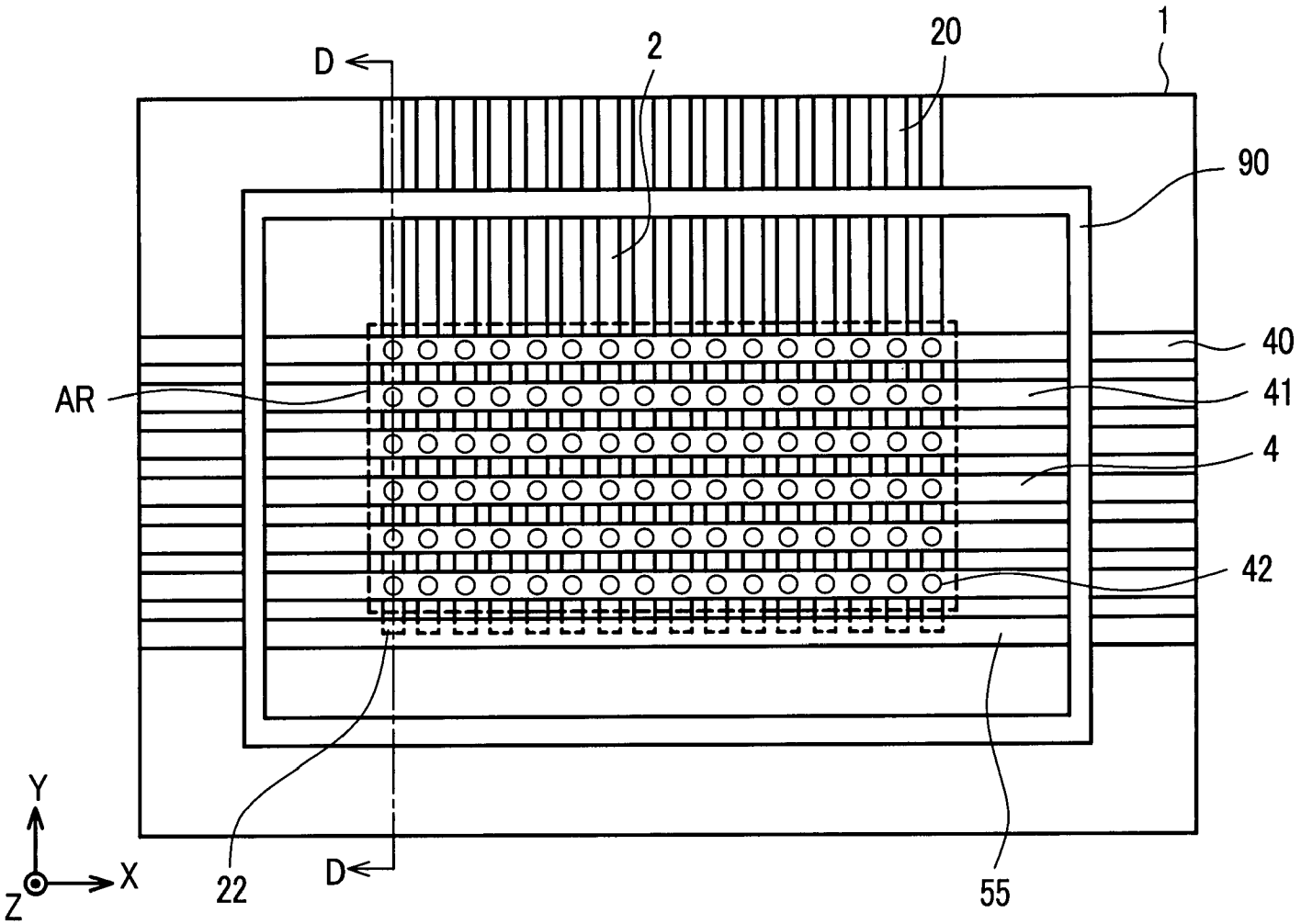
FIG. 7 is a plan view showing the constitution of a back panel representing a fourth embodiment of a display device according to the present invention.
Figure 8:
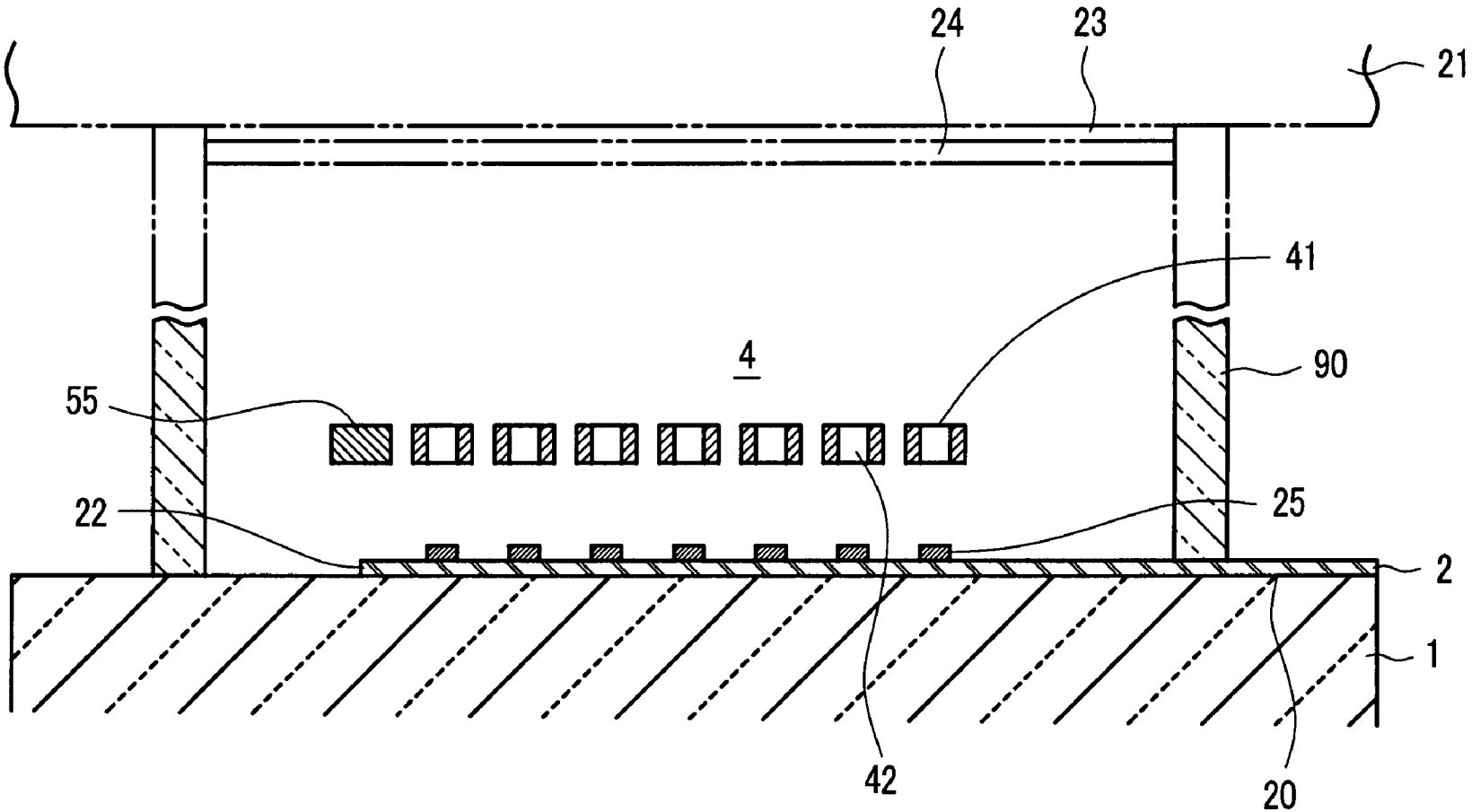
FIG. 8 is a cross-sectional view taken along a line D—D in FIG. 7.

FIG. 7 is a plan view schematically showing the constitution of a back substrate representing a fourth embodiment of the display device according to the present invention. Further, FIG. 8 is a cross-sectional view taken along a line D—D in FIG. 7. In FIG. 7 and FIG. 8, parts having functions identical to the parts shown in FIG. 1 to FIG. 6 are given identified by the symbols. As seen, in FIG. 8, the relationship among the face substrate 21, the anode 23 and fluorescent material 24 is indicated by a phantom line in the same manner as the display device shown in FIG. 2, FIG. 4 and FIG. 6.

In the fourth embodiment shown in FIG. 7 and FIG. 8, the cathode-line lead lines 20 of the cathode lines 2 are arranged on only one side of the display area AR on the back substrate 1, and, hence, this embodiment differs in constitution from the above-mentioned respective embodiments. Due to such an arrangement of the cathode-line lead lines 20 of the cathode lines 2, the terminals 22 thereof are also arranged in one row in the y direction, and, hence, only one shield member 55 is provided to ensure shielding between the terminals 22 and the anode 23. The constitution, the arrangement, the position and the like of the shield member 55 are the same as that of a single shield member of the first embodiment, which was described with reference to FIG. 1 and FIG. 2.

Due to the constitution provided by this embodiment, in addition to the above-mentioned effect in which the generation of a spark and a dark current is superposed, since the cathode-line lead lines 20 are pulled out only to one side on the back substrate 1, it is possible to obtain an advantageous in effect that the connection with external circuits is facilitated, whereby it is possible to obtain a display device which can produce a display with high definition and can exhibit high reliability and a long lifetime.

Figure 9:
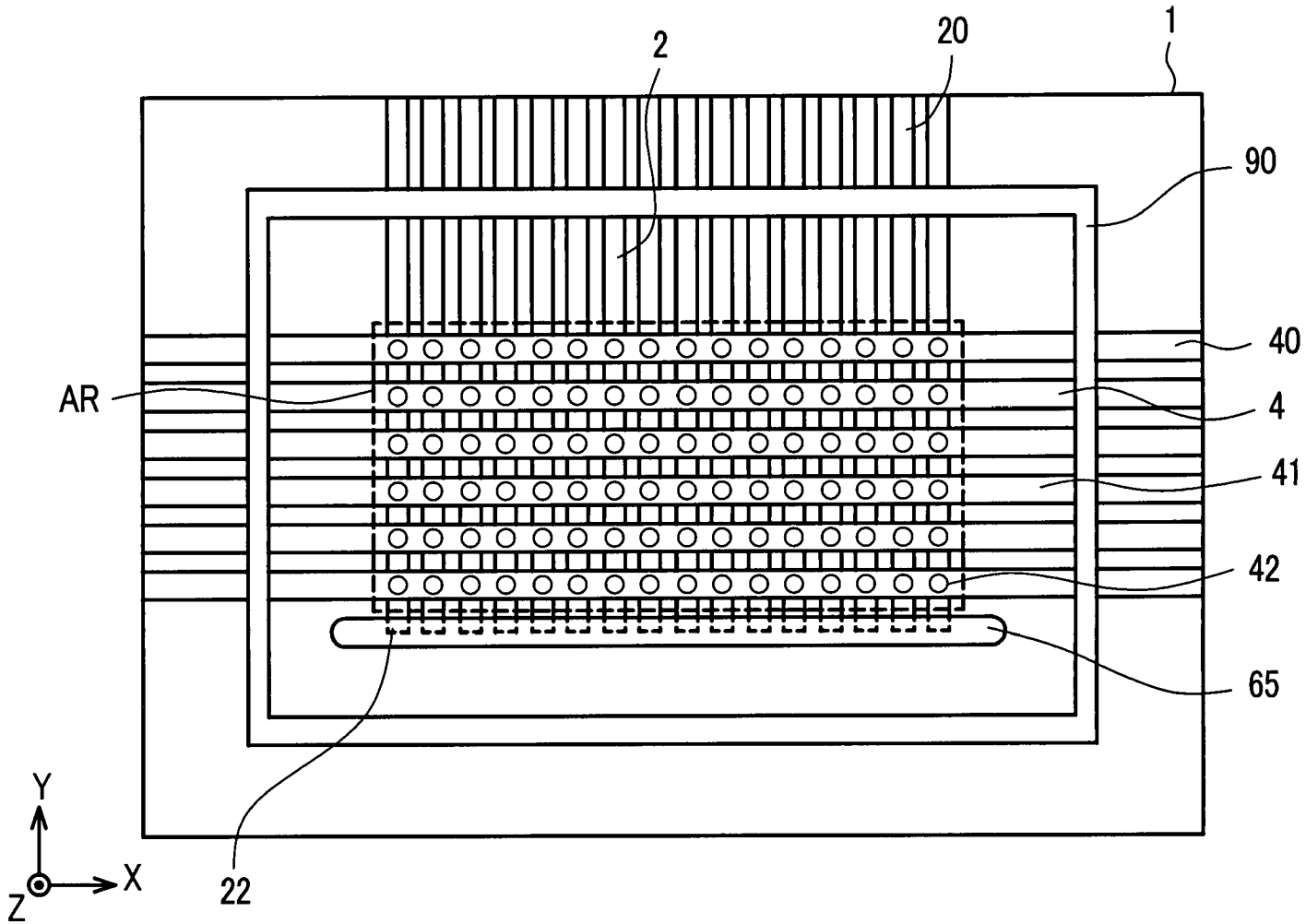
FIG. 9 is a plan view showing the constitution of a back panel representing a fifth embodiment of a display device according to the present invention.

FIG. 9 is a plan view schematically showing the constitution of a back substrate in a fifth embodiment of the display device according to the present invention. In FIG. 9, parts having functions identical to the parts shown in FIG. 1 to FIG. 8 are identified by the same symbols. In the embodiment shown in FIG. 9, the same basic structural features as employed in the embodiment shown in FIG. 7 and FIG. 8, wherein cathode-line lead lines 20 of cathode lines 2 are arranged only at one side of the display area on the back substrate 1, are employed. In such a constitution, the terminals 22 are additionally covered with and are shielded by a shield member 65, which constitutes an insulator, such as frit glass, in the same manner as employed in the second embodiment, which was described in conjunction with FIG. 3 and FIG. 4.

By adopting the constitution provided by this embodiment, it is possible to obtain a display device which can produce a high-definition display and can exhibit high reliability and long lifetime, while simultaneously obtaining the advantageous effects of the above-mentioned second and fourth embodiments.

Figure 10:
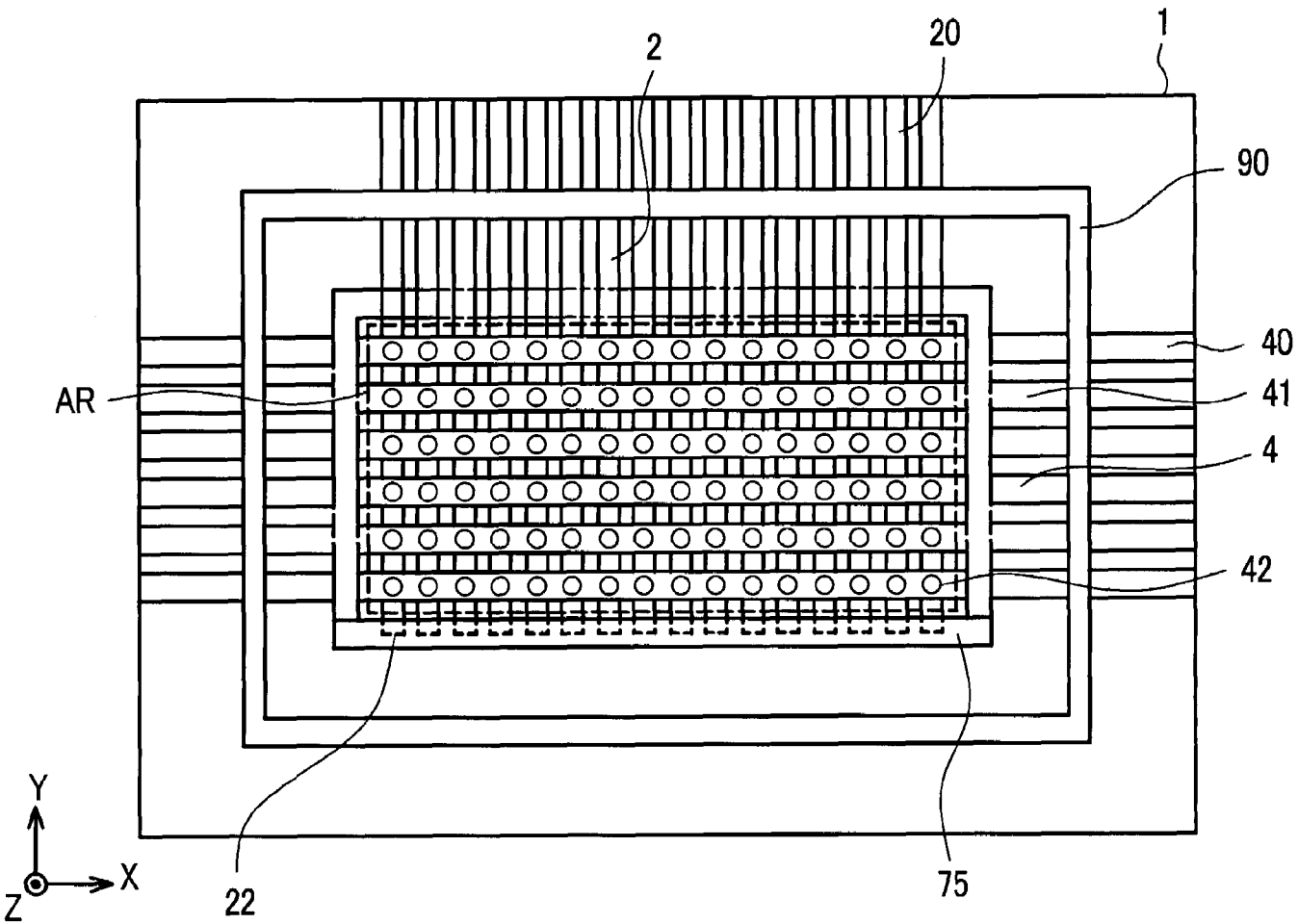
FIG. 10 is a plan view showing the constitution of a back panel representing a sixth embodiment of a display device according to the present invention.

FIG. 10 is a plan view schematically showing the constitution of a back substrate representing a sixth embodiment of the display device according to the present invention. In FIG. 10, parts having functions identical to the parts shown in FIG. 1 to FIG. 9 are identified by the same symbols. In the embodiment shown in FIG. 10, in the same manner as the embodiment shown in FIG. 7 to FIG. 9, cathode-line lead lines 20 of cathode lines 2 are arranged only at one side of the display area AR on the back substrate 1. In such a constitution, the terminals 22 are covered with a plate-like shield member 75, which is formed of a glass plate or a ceramic plate, so as to provide shielding between the anode 23 and the terminals 22 in the same manner as the third embodiment, which was described in conjunction with FIG. 5 and FIG. 6.

By adopting the constitution provided by this embodiment, it is possible to obtain a display device which can produce a high-definition display and can exhibit high reliability and a long lifetime, while simultaneously obtaining the advantageous effects of the above-mentioned third and fourth embodiments.

Figure 11:
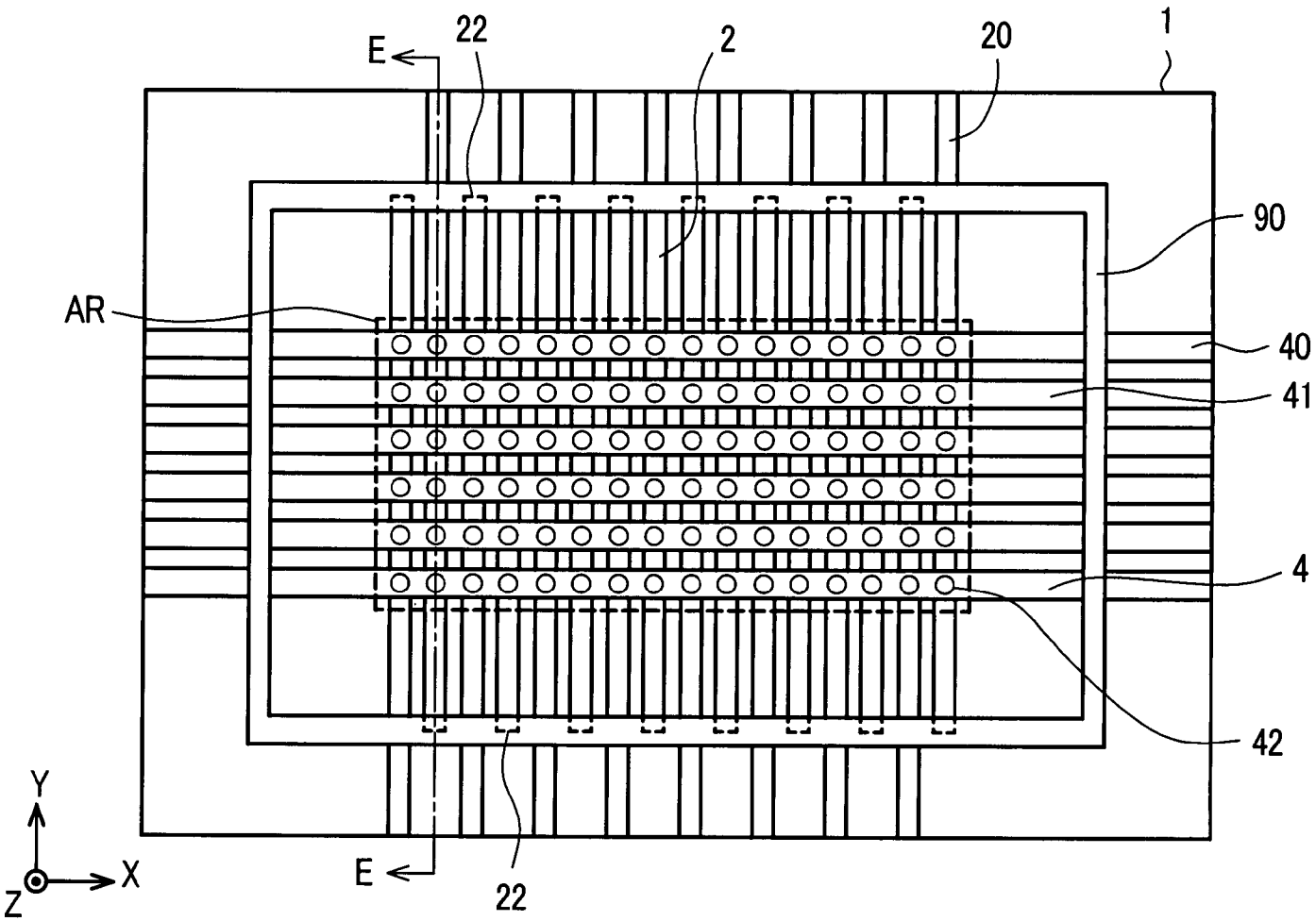
FIG. 11 is a plan view showing the constitution of a back panel representing a seventh embodiment of a display device according to the present invention.
Figure 12:
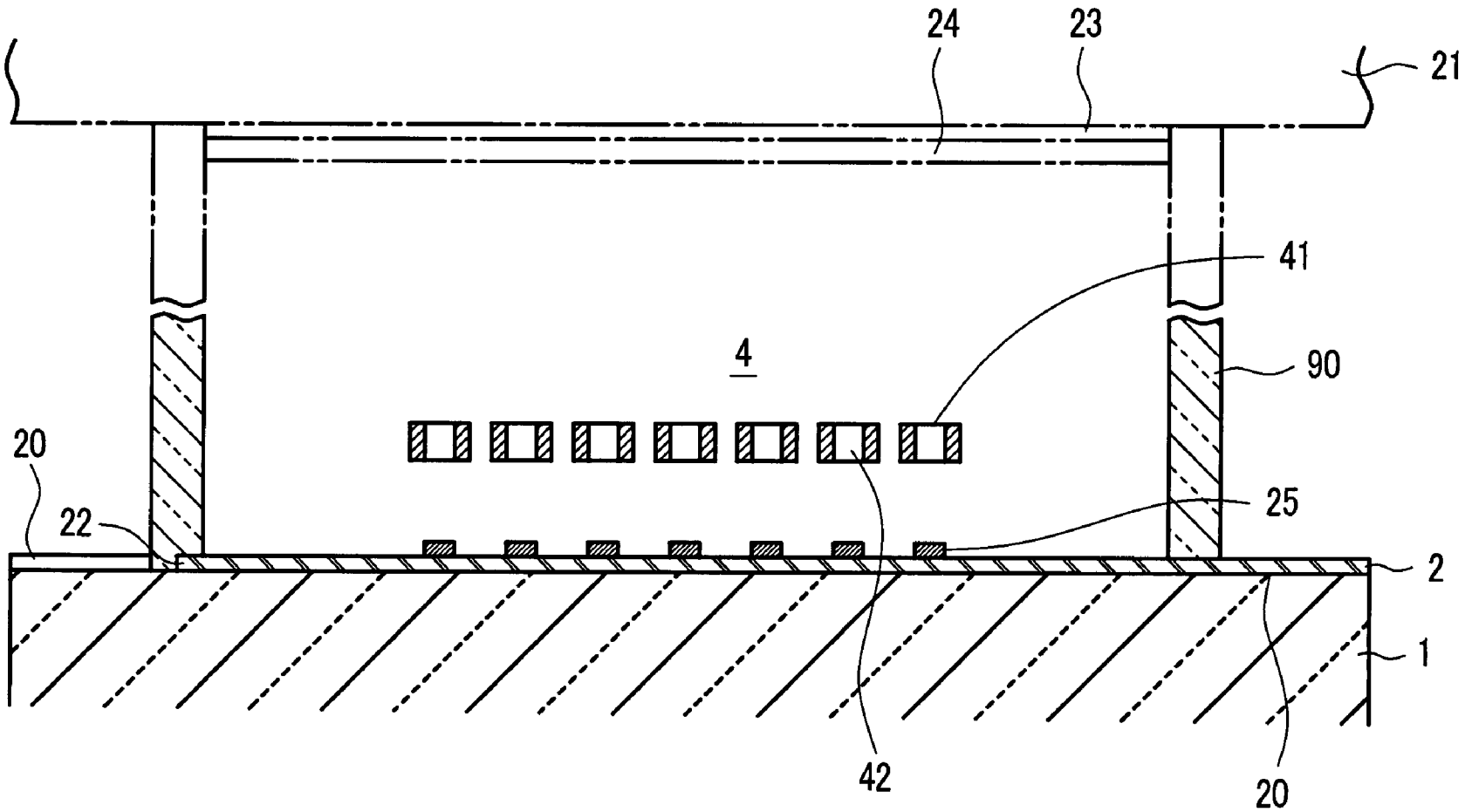
FIG. 12 is a cross-sectional view taken along a line E—E in FIG. 11.

FIG. 11 is a plan view schematically showing the constitution of a back substrate representing a seventh embodiment of the display device according to the present invention. Further, FIG. 12 is a cross-sectional view taken along a line E—E in FIG. 11. In FIG. 11 and FIG. 12, parts having functions identical to the parts shown in FIG. 1 to FIG. 10 are identified by the same symbols. In FIG. 12, the relationship among the face substrate 21, the anode 23 and fluorescent material 24 is indicated by a phantom line in the same manner as the display device shown in FIG. 2, FIG. 4, FIG. 6 and FIG. 8.

In the seventh embodiment shown in FIG. 11 and FIG. 12, the terminals 22 of the cathode lines 2 are made to extend below a frame body 90 which constitutes a sealing frame, and the frame body 90 is superposed on the terminals 22, whereby the frame body 90 also serves as a shield member which performs shielding between the terminals 22 and the anode 23. Here, in this embodiment, cathode-line lead lines 20 of the cathode lines 2 extend alternately on both sides of the display area AR on the back substrate 1, every other line.

Due to the constitution provided by this embodiment, it is possible to make an existing constitutional member also function as the shield member, in addition to the above-mentioned advantageous effect in which the generation of a spark or a dark current is superposed, whereby an enhancement of the operability and a reduction of the cost can be expected, so as to make it possible to obtain a display device which can produce a high-definition display and can exhibit high reliability and a long lifetime.

Figure 13:
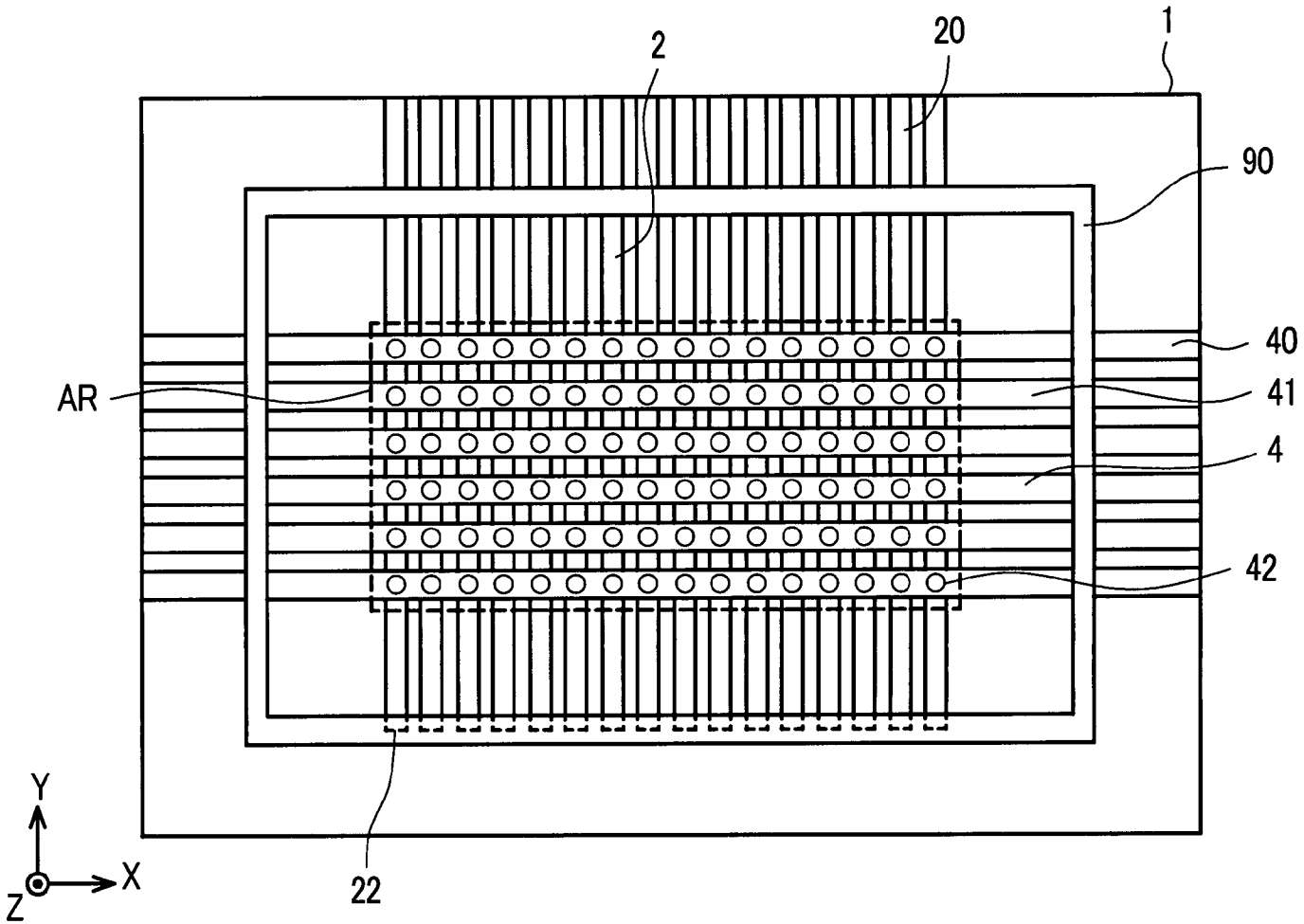
FIG. 13 is a plan view showing the constitution of a back panel representing an eighth embodiment of a display device according to the present invention.

FIG. 13 is a plan view schematically showing the constitution of a back substrate representing an eighth embodiment of the display device according to the present invention. In FIG. 13, parts having functions identical to the parts shown in FIG. 1 to FIG. 12 are identified by the same symbols. In the eighth embodiment shown in FIG. 13, the cathode-line lead lines 20 of the cathode line 2 are arranged only at one side of the display area AR on the back substrate 1; and, the terminals 22 of the cathode lines 2 are arranged in one line in the y direction, and their ends extend below the frame body 90, which constitutes a sealing frame, so that the frame body 90.

Due to the constitution provided by this embodiment, it is possible to make an existing constitutional member also function as the shield member, in addition to the above-mentioned advantageous effect in which the generation of a spark or a dark current is superposed, whereby enhancement of the operability and reduction of the cost can be expected. Further, it is possible to obtain a display device which can produce a high-definition display and can exhibit high reliability and a long lifetime, while simultaneously obtaining the advantageous effect of the fourth embodiment.

Figure 14:
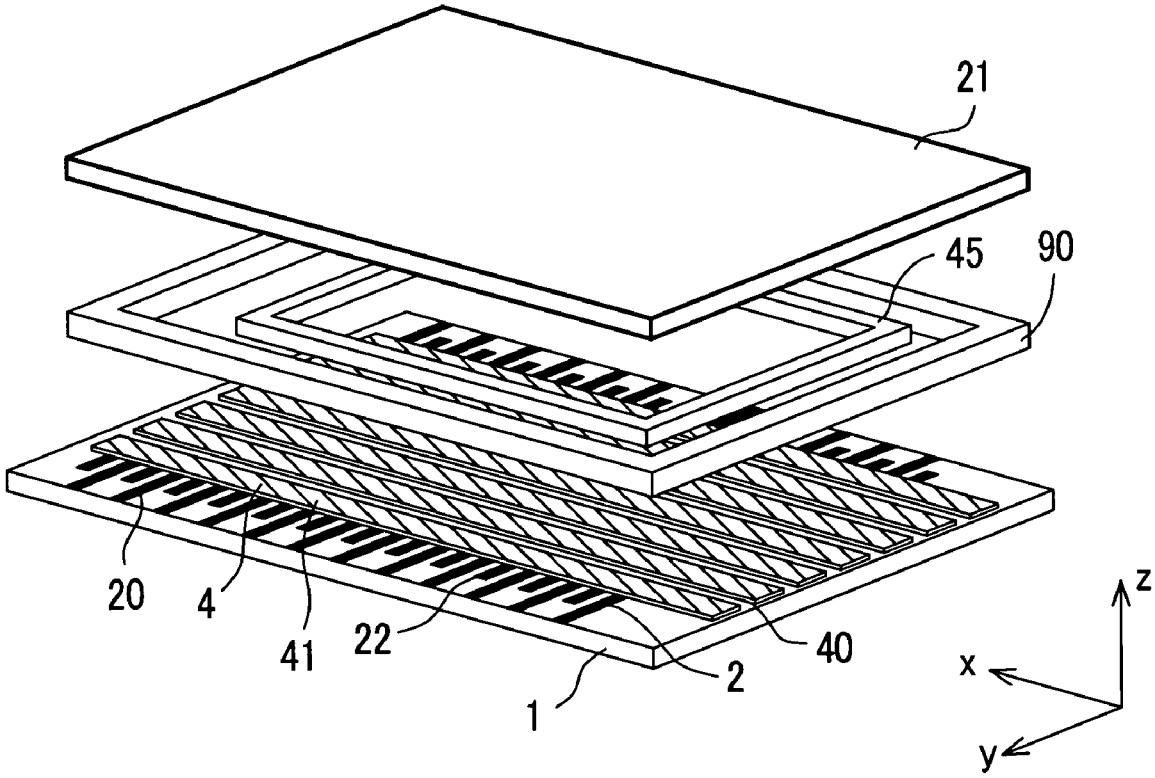
FIG. 14 is a developed perspective view showing the overall constitution of the display device of the present invention.

FIG. 14 is a developed perspective view schematically showing the overall constitution of a display device of the present invention. The display device shown in FIG. 14 is based on the constitution of the third embodiment of the present invention shown in FIG. 5 and FIG. 6. In FIG. 14, on an inner surface of the back substrate 1, a large number of cathode lines 2 extend in a first direction (y direction) and are juxtaposed in a second direction (x direction) which crosses the above-mentioned first direction. Electron emitting sources, such as carbon nanotubes, are formed on face-substrate-21-side surfaces of the cathode lines 2. Further, there are control electrodes 4 formed of a plurality of strip-like electrode elements 41, which extend in the above-mentioned second direction (x direction) so as to cross the cathode lines 2 and are juxtaposed in the above-mentioned first direction (y direction). In the drawing, the electron passing apertures are omitted. Further, an anode and a fluorescent material are formed on the inner surface of the face substrate 21. The back substrate 1 and the face substrate 21 are sealed by the frame body 90.

A shield member 45 is provided inside a frame body 90, and the terminals 22 of the cathode lines 2 and an anode formed on an inner surface of the face substrate 21 are shielded from each other by the shield member 45. Video signals are supplied to the cathode lines 2 through the cathode-line lead lines 20. Control signals (scanning signals) are supplied to the control electrodes 4 through the control electrode lead terminals 40.

Figure 15:
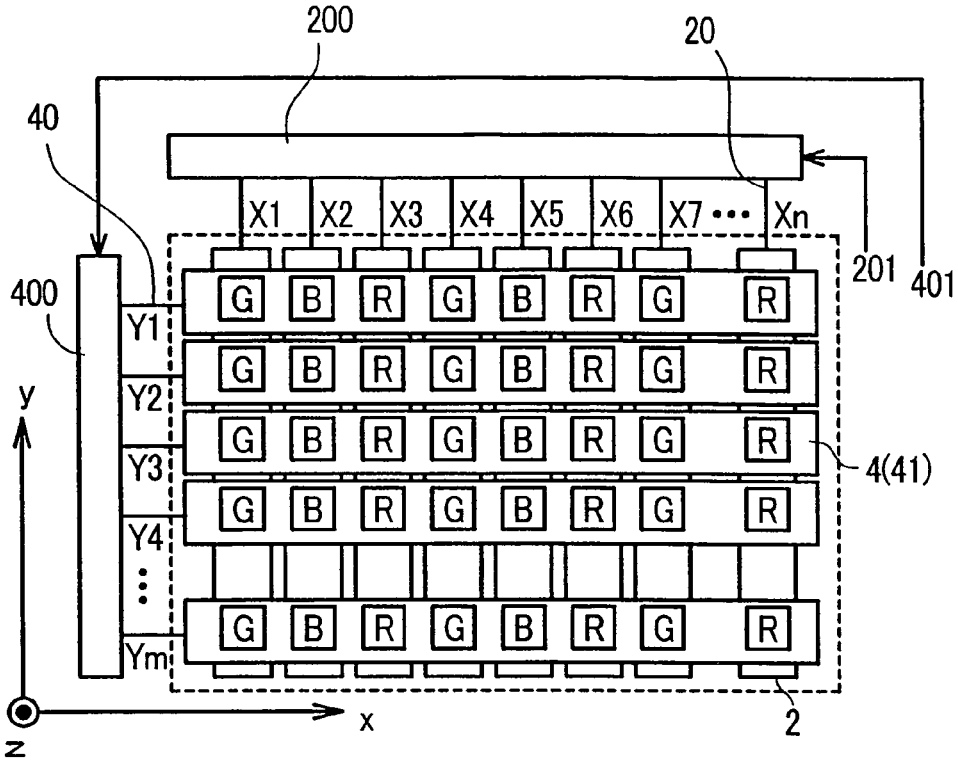
FIG. 15 is an equivalent circuit diagram of the display device of the present invention.
Figure 16:
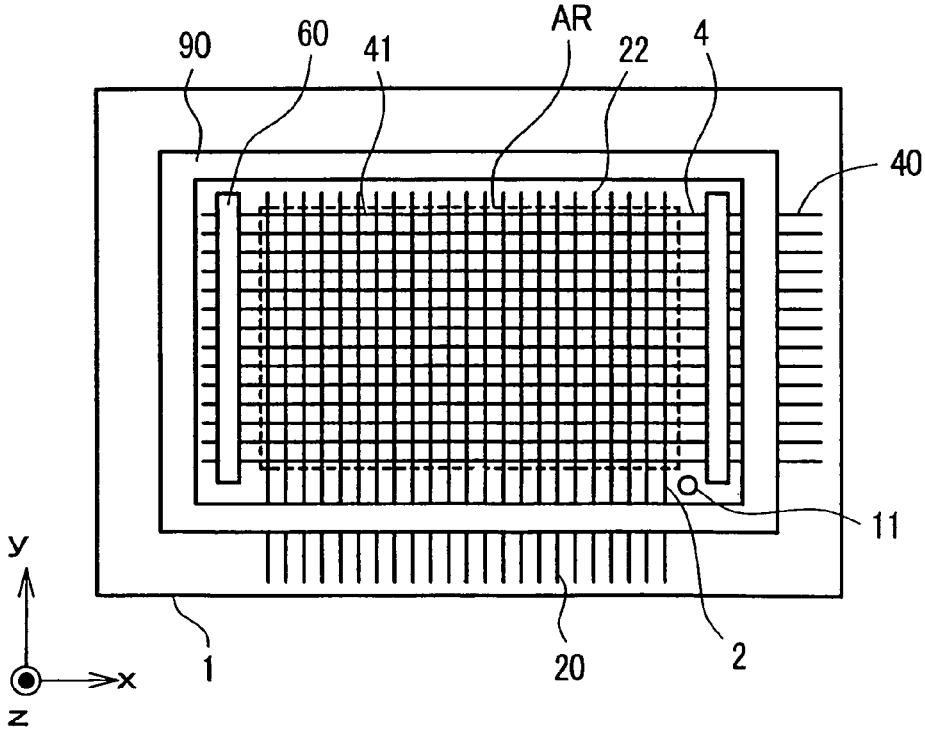
FIG. 16 (PRIOR ART)
FIG. 16 is a plan view of a back substrate as provided in a field emission type display device.

FIG. 15 is a diagram showing an example of an equivalent circuit of the display device of the present invention. The region indicated by a broken line in the drawing indicates a display region. In the display region, the cathode lines 2 and the control electrodes 4 (strip-like electrode elements 41) are arranged to cross each other, thus forming a matrix of n×m display elements. Respective crossing portions of the matrix constitute unit pixels and one color pixel is constituted of a group of "R", "G", "B" elements in the drawing. The cathode lines 2 are connected to a video drive circuit 200 through the cathode-line lead lines 20 (X1, X2, . . . Xn), while the control electrodes 4 are connected to a scanning drive circuit 400 through control-electrode lead lines 40 (Y1, Y2, . . . Ym).

The video signals 201 are inputted to the video drive circuit 200 from an external signal source, while scanning signals (synchronous signals) 401 are inputted to the scanning drive circuit 400 in the same manner. Accordingly, given pixels, which are sequentially selected by the strip-like electrode elements 41 and the cathode lines 2, emit light in given colors, thus displaying two-dimensional images. With the use of a display device having such a constitution, it is possible to realize a flat-panel type display device which can be operated with high efficiency at a relatively low voltage.

As has been explained in conjunction with illustrated embodiments, according to the typical constitutions of the present invention, by shielding the terminals of the cathode lines from the anode using a shield member, it is possible to prevent the generation of a spark and a dark current and to obviate the creation of an unstable display and a degraded display, whereby a display device which exhibits a long lifetime and which produces images with a high reliability can be provided.

What is claimed is:

1. A display device comprising:

a face substrate which has an anode and a fluorescent material on an inner surface thereof;

a plurality of cathode lines which extend in a first direction, are juxtaposed in a second direction which crosses said first direction, and has electron emitting sources;

control electrodes which are constituted by arranging a plurality of strip-like electrode elements which cross the cathode lines in a non-contact state within a display region, extend in said second direction and are juxtaposed in said first direction, and have electron passing apertures for allowing electrons from the electron emitting sources to pass therethrough toward the face substrate;

a back substrate which has said control electrodes and said cathode lines disposed on an inner surface thereof and which faces the face substrate with a given distance therebetween; and a frame body which is inserted between the face substrate and the back substrate and is arranged around the display region to maintain said given distance, wherein the cathode lines have terminal ends that are terminated outside the display region and inside the frame body, and a shield member is inserted between the terminal ends of the cathode lines and the anode, the shield member having an electric potential which is lower than an electric potential of the anode.

2. A display device according to claim 1, wherein the shield member is a member having the same shape as a strip-like electrode element which does not have the electron passing apertures.

3. A display device according to claim 1, wherein the shield member is a member having the same shape as a strip-like electrode element which has the electron passing apertures.

4. A display device comprising:

a face substrate which has an anode and a fluorescent material on an inner surface thereof;

a plurality of cathode lines which extend in a first direction, are juxtaposed in a second direction which crosses said first direction, and has electron emitting sources;

control electrodes which are constituted by arranging a plurality of strip-like electrode elements which cross the cathode lines in a non-contact state within a display region, extend in said second direction and are juxtaposed in said first direction, and have electron passing apertures for allowing electrons from the electron emitting sources to pass therethrough toward the face substrate;

a back substrate which has said control electrodes and said cathode lines disposed on an inner surface thereof and which faces the face substrate with a given distance therebetween; and a first frame body which is inserted between the face substrate and the back substrate and is arranged around the display region to maintain said given distance, wherein the cathode lines have terminal ends that are terminated outside the display region and inside the frame body, and a shield member is inserted between the terminal ends of the cathode lines and the anode, and the shield member is constituted of a second frame body which has substantially the same height as the first frame body.

5. A display device comprising:

a face substrate which has an anode and a fluorescent material on an inner surface thereof;

a plurality of cathode lines which extend in a first direction, are juxtaposed in a second direction which crosses said first direction, and has electron emitting sources;

control electrodes which are constituted by arranging a plurality of strip-like electrode elements which cross the cathode lines in a non-contact state within a display region, extend in said second direction and are juxtaposed in said first direction, and have electron passing apertures for allowing electrons from the electron emitting sources to pass therethrough toward the face substrate;

a back substrate which has said control electrodes and said cathode lines disposed on an inner surface thereof and which faces the face substrate with a given distance therebetween; and a frame body which is inserted between the face substrate and the back substrate and is arranged around the display region to maintain said given distance, wherein the cathode lines have terminal ends that are terminated at positions outside the display region, and the frame body is superposed on the terminal ends of the cathode lines.

* * * * *